United States Patent [19]

Bresle

[11] 3,971,628

[45] July 27, 1976

[54] METHOD FOR INHIBITING RUST FORMATION ON IRON-CONTAINING ARTICLES

[75] Inventor: Ake Roland Albin Bresle, Stocksund, Sweden

[73] Assignee: Aminkemi AB, Bromma, Sweden

[22] Filed: Nov. 21, 1974

[21] Appl. No.: 525,957

Related U.S. Application Data

[62] Division of Ser. No. 228,312, Feb. 22, 1972, abandoned.

[30] Foreign Application Priority Data

Mar. 9, 1971 Sweden ..... 2955/71

[52] U.S. Cl. ..... 21/2.7 R; 252/389 R

[51] Int. Cl.[2] ..... C23F 11/00; C23F 11/08

[58] Field of Search ..... 21/2.7 R; 134/2; 148/6.14 R; 106/14; 252/82, 86, 158, 180, 192, 389 R

[56] References Cited

UNITED STATES PATENTS

| | | | |
|---|---|---|---|
| 2,289,443 | 7/1942 | Mange | 148/6.14 R |
| 2,892,738 | 6/1959 | Dobratz | 134/2 |
| 3,173,404 | 3/1965 | Bloom et al. | 21/2.7 R X |
| 3,634,278 | 1/1972 | Wolverton | 134/2 X |
| 3,708,429 | 1/1973 | Hall | 252/156 |
| 3,796,608 | 3/1974 | Pearlman | 106/14 X |

FOREIGN PATENTS OR APPLICATIONS

| | | | |
|---|---|---|---|
| 1,127,684 | 4/1962 | Germany | 21/2.7 |
| 1,278,802 | 9/1968 | Germany | 134/2 |
| 4,513,688 | 5/1970 | Japan | 21/2.7 |
| 368,619 | 3/1931 | United Kingdom | 21/2.7 |

OTHER PUBLICATIONS

Kirk–Othmer; "Encyclopedia of Chem. Tech.;" pp. 61 and 70.

"Chem. Abstracts;" p. 6917; 55–Ferrous Metals & Alloys; vol. 68; 1968.

"Chem. Abstracts;" p. 265; 61–Water; vol. 72; 1970.

*Primary Examiner*—Joseph Scovronek
*Assistant Examiner*—Braney R. Garris
*Attorney, Agent, or Firm*—Toren, McGeady and Stanger

[57] ABSTRACT

The corrosion of an article of iron or steel can be reduced or prevented if the surface of the article is washed with a solution of lithium hydroxide in an organic solvent which is also a solvent for water and lithium chloride. This treatment removes chlorides and other corrosion accelerators from the surface of the article.

8 Claims, No Drawings

METHOD FOR INHIBITING RUST FORMATION ON IRON-CONTAINING ARTICLES

This is a division of application Ser. No. 228,312 filed Feb. 22, 1972 and now abandoned.

This invention is concerned with a method and a composition for preventing rusting of articles or iron, steel or ferrous alloys.

When unprotected articles or iron, steel or iron containing alloys are exposed to the atmosphere or to water or soil they are attacked by chemical corrosion — they rust — and during this process different impurities from the ambient environment are adsorbed on the metal surface and in the rust layer formed on the metal surface. Some of these impurities act as accelerators on the further corrosion process. Among the natural corrosion accelerators are especially sulphur dioxide and salts of different kinds, particularly sodium chloride, for example originating from sea water.

Outdoors, the relative humidity is usually so high that the water necessary for the corrosion processes will be present as a moisture or water film on the surface of the article and in its rust layer. The chlorides are dissolved in this water film and generate in the case of sodium chloride, sodium and chloride ions. The sulphur dioxide dissolved in said water film is partly ionized to form sulphite or bisulphite ions, depending upon the pH value of the liquid.

In order to preserve permanently articles of metal, that have been in contact with the atmosphere or with water or soil, for example archeological steel objects, steel bridges, iron or steel structures, ships, boats of steel etc., it is necessary to remove the corrosion accelerators, that is the chloride ions, soluble sulphur compounds and water and subsequently to passivate the metal surface or to cover it with a surface layer that can protect the metal against additional corrosion.

To protect small steel articles, especially archeological articles, a two-step procedure has previously been used consisting in washing the article with distilled water so as to remove corrosion accelerators, and subsequently drying the article in vacuum in the presence of a desiccant. The articles have subsequently been permanently stored in premises where the relative humidity does not exceed 50 – 60%.

When treating bigger steel articles the rust has usually been removed by means of a mechanical treatment, and a primer paint and a top coat paint have subsequently been applied to the surface. In this case corrosion accelerators have often remained underneath the primer due to incomplete cleaning, and have proceeded their attacks on the steel, resulting in the loosening of the paint. Not even the washing procedure with distilled water as described above will create a reliable method of entirely taking away the chlorides, since small quantities of chlorides often remain at some points on the surface.

This invention provides a new method and a new composition which will give a better and more complete removal of chlorides and sulphur compounds, and which to some extent also will passivate the surface of the metal article, also underneath a rust layer.

It is a particular object of the invention to provide such a complete removal of the corrosion accelerators that the metal article can be painted even if the rust layer has not been removed.

The method according to this invention comprises washing the article with a solution of lithium hydroxide in an organic solvent in which lithium chloride and water are at least slightly soluble.

The method is based upon the fact that the corrosion accelerators combined with lithium ions have a certain solubility in the organic solvent. Therefore, the corrosion accelerators can be effectively washed away from the metal surface by means of one or several treatments with the lithium hydroxide solution. For example the solubility of some of the relevant compounds in water and ethanol is given in the table below:

| Compound | Solubility in water | Solubility in ethanol |
|---|---|---|
| NaCl | very good | insoluble |
| NaOH | very good | good |
| LiCl | very good | good |
| LiOH | very good | good |
| $SO_2$ | good | good |
| $Na_2SO_3$ } $NaHSO_3$ } | good | low but measurable |

When treated with the lithium hydroxide solution the chloride ions present in the moisture film close to the metal or rust surface will be transferred to the organic solvent as lithium chloride, owing to the fact that it is soluble in the solvent. Therefore, the chloride ions will be washed away by the solvent. In the same way the soluble sulphur dioxide and other sulphur compounds will be washed away. According to the fact that the solvent also has some solubility for water, the moisture or water on the metal surface will also be removed during the process. A treatment time of a few minutes will usually be sufficient. If the metal surface is covered with a heavy rust layer, it may be desired to treat the article with the solution for a few hours.

It is desired that the solvent shall also have some solubility for fats and oils. Such a solvent will remove, for example, lubricants and other organic impurities which are often present on the metal surface.

Small articles can be dipped in a vessel containing the lithium hydroxide solution, and when the article has been soaked for enough time it is taken up and can be dried in air. Only small residues of sodium hydroxide and lithium hydroxide will be left on the metal or rust surfaces and these small residues will be converted to the corresponding carbonates by the carbon dioxide of the air. An alkaline environment has now been created close to the metal surface, and the increased pH value will passivate the steel surface so that further rusting is prevented, or reduced.

To prevent the moisture from the air to be dissolved in the alcohol the soaking vessel might be closed with a cover. A soaking time of about some hours at room temperature for small articles will be quite enough but the time can be shortened considerably by stirring and/or heating the solution. The solution can be used several times until the chloride concentration has increased to 0.1 – 0.2 grams per liter, as there will now be a risk that the chlorides remain on the metal surface. When a chloride analysis has shown too high values of the chloride concentration of the solution the solvent can be recovered by distillation. Bigger articles can be treated by the solution being sprayed onto the surface of the article and allowed to flow away. Alternatively, the solution may be applied onto the surface by means of a brush or a sponge.

A suitable concentration of the lithium hydroxide in the solvent is 0.1 – 1.0 per cent by weight. If ethanol is used as solvent, a suitable concentration will be about 0.2 grams lithium hydroxide per liter alcohol, which roughly corresponds to about 10 per cent of the saturating value at room temperature.

Reference has been made to ethanol as a suitable solvent for the composition of this invention. Other alcohols are also useful, and preferably the lower aliphatic alcohols. For example when a very rapid evaporation of the solvent is desired, addition of methanol can be made or, when a slow evaporation is desired, addition of higher alcohols, propanol or butanol. Other useful solvents are ketones, preferably aliphatic ketones of formula

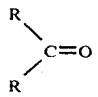

wherein the groups R are the same or different and represent lower alkyl, such as methyl, ethyl, propyl or butyl, e.g. acetone or methyl ethyl ketone;

amides, preferably aliphatic amides having the general formula

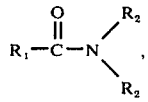

wherein $R_1$ is hydrogen or ($C_1$ – $C_4$)-alkyl, $R_2$ are the same or different and are members of the group comprising hydrogen and ($C_1$ – $C_4$)alkyl, e.g. formamide, acetamide, N-methylformamide, dimethylacetamide or dimethylformamide, or N-(lower alkyl)substituted phosphoric- or phosphorous-triamides, such as hexamethylphosphoric-triamide $[(CH_3)_2N]_3PO$ and hexamethylphosphoroustriamide $[(CH_3)_2N]_3P$;

sulfones and sulfoxides, preferably cyclic sulfones of the type sulfolane, and di(lower alkyl)sulfoxides, e.g. dimethyl sulfoxide;

nitriles, preferably ($C_1$ – $C_4$)alkylnitriles, such as acetonitrile;

glycolethers, preferably di(lower alkylene)glycol-di(-lower alkyl)ether, e.g. diethylene glycol-dimethyl ether;

nitro compounds, such as nitrated alkanes, e.g. nitromethane, and nitrobenzene;

amines, such as tertiary aliphatic or aromatic amines, and such heterocyclic amines in which the nitrogen atom is a member of the ring, such as pyridine and benzopyridines, e.g. quinoline.

Of course, mixtures of various solvents are also useful.

The composition of the invention may also contain other ingredients. A useful additive is a small percentage of a wetting agent, such as an alkyl-aryl sulphonate. If the article to be treated is covered with a layer of rust, the wetting agent facilitates the penetration of the solution through the rust layer.

When treating bigger metal articles it may be useful to add a thickening agent such as a colloidal silicic acid, e.g. Cab-O-Sil, Aerosil, etc. (trade names), to the composition. The thickening agent may be added in such a quantity that it gives the composition a paste-like consistency. This paste-like composition is applied to the surface to be treated, and is allowed to remain on the surface for the desired time. The composition is now removed and the surface can now be painted, if desired.

EXAMPLE

Steel plates having a size of 150 by 100 millimeters were exposed to the outdoor atmosphere for 5 months, to produce a rust layer on the surfaces of the plates. The loosely adhering rust layer was now removed by means of a steel wire brush. The plates were now treated as follows:

A. Three plates were immersed for 10 minutes into a solution of 0.2 per cent by weight of lithium hydroxide in ethyl alcohol at normal temperature. The wet plates were dried by means of pressurized air.

B. Three plates were treated as described in Example (A), but the liquid consisted of pure ethyl alcohol.

C. Three plates were immersed in distilled water for 10 minutes at normal temperature, and were subsequently dried by means of pressurized air.

D. As a comparison, three plates were not treated with any liquid at all.

The plates, thus pre-treated, were painted with red lead paint, applied in a quantity of 3.5 grams on each plate. The painted plates were allowed to dry for 14 days at normal temperature.

The painted plates were now exposed to an accelerated corrosion test in a salt spray cabinet according to the ASTM standard test method. The plates were inspected after 1, 4, 6, 11, 15, 18 and 22 days, and the corrosion was observed. The result is given in the table below, in a 10 point scale in which the mark "10" means that no rusting has occurred, and the mark "1" means that the entire surface of the plate had been covered with rust. The result given is the intermediate value obtained for each set of three plates.

| Pretreatment | 1 | 4 | 6 | 11 | 15 | 18 | 22 days |
|---|---|---|---|---|---|---|---|
| (A) | 10 | 8 | 8 | 6 | 5 | 5 | 4 |
| (B) | 10 | 7 | 5 | 3 | 2 | 1 | 1 |
| (C) | 10 | 7 | 7 | 4 | 3 | 3 | 2 |
| (D) | 10 | 8 | 6 | 4 | 2 | 1 | 1 |

The plates (A) which had been treated according to the invention were clearly superior to the other plates after 22 days.

What is claimed is:

1. A method of inhibiting rust formation on the surfaces of an iron-containing article whose surfaces have lodged thereon corrosion accelerators selected from the group consisting of metal chloride, sulfur-containing compounds and water, said method comprising removing said corrosion accelerators by washing the article with a solution consisting essentially of 0.1 to 1.0 percent by weight of lithium hydroxide in an organic solvent in which lithium chloride and water are at least slightly soluble, and drying the article, whereby a protective layer is formed on the article.

2. A method as claimed in claim 1, in which the solvent is also a solvent for fat and oil.

3. A method as claimed in claim 1, wherein the article is washed in a closed vessel.

4. A method as claimed in claim 1, in which the solution also contains a thickening agent.

5. A method as claimed in claim 4, in which the thickening agent is colloidal silicic acid.

6. A method as claimed in claim 1, in which the solvent is a member selected from the group consisting of lower aliphatic alcohols;

aliphatic ketones of the general formula

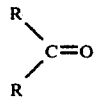

wherein the R groups are the same or different and represent lower alkyl hydrocarbons;

aliphatic amides having the general formula

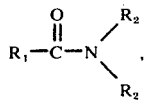

wherein $R_1$ is hydrogen or ($C_1$ – $C_4$)-alkyl, and the $R_2$ groups are the same or different and are members selected from the group consisting of hydrogen and ($C_1$ – $C_4$) alkyl;

cyclic sulfones of the sulfolane type, and di(lower alkyl) sulfoxides;

($C_1$ – $C_4$) alkylnitriles;

di(lower alkylene) glycol-di(lower alkyl) ether;

nitrated alkanes; and tertiary, aliphatic or aromatic amines, and such heterocyclic amines in which the nitrogen atom is a member of a pyridine or benzopyridine ring.

7. A method as claimed in claim 6 in which the solvent is a member selected from the group consisting of methanol, ethanol, propanol, butanol, acetone, methyl ethyl ketone, formamide, acetamide, N-methylformamide, dimethylacetamide, dimethylformamide, N-(lower alkyl)substituted phosphoric- or phosphorous-triamides, dimethyl sulfoxide, acetonitrile, diethylene glycol-dimethyl ether, nitromethane, nitrobenzene and quinoline.

8. A method as claimed in claim 6, wherein the solvent is hexamethylphosphoric-triamide $[(CH_3)_2N]_3PO$ or hexamethylphosphorous-triamide $[(CH_3)_2N]_3P$.

* * * * *